US006030301A

United States Patent [19]

Asada et al.

[11] Patent Number: 6,030,301

[45] Date of Patent: Feb. 29, 2000

[54] SPORTS POSTS

[75] Inventors: Yasuhiro Asada, Shiga-ken; Hideyuki Yamamoto, Otsu, both of Japan

[73] Assignee: Toray Industries, Inc., Tokyo, Japan

[21] Appl. No.: 08/981,414

[22] PCT Filed: Apr. 10, 1996

[86] PCT No.: PCT/JP96/02899

§ 371 Date: Feb. 17, 1998

§ 102(e) Date: Feb. 17, 1998

[87] PCT Pub. No.: WO97/38761

PCT Pub. Date: Oct. 23, 1997

[30] Foreign Application Priority Data

Apr. 16, 1996 [JP] Japan ..... 8-093887
May 23, 1996 [JP] Japan ..... 8-128258

[51] Int. Cl.[7] ..... A63B 61/00
[52] U.S. Cl. ..... 473/492
[58] Field of Search ..... 473/492, 493, 473/491

[56] References Cited

U.S. PATENT DOCUMENTS 4,122,451 10/1978 Senoh ..... 473/492
5,215,310 6/1993 Allbright ..... 473/493
5,242,174 9/1993 Koole ..... 473/492
5,308,085 5/1994 Koole ..... 473/493
5,358,257 10/1994 Pardi ..... 473/493
5,393,069 2/1995 Taylor ..... 473/493

*Primary Examiner*—Theatrice Brown
*Attorney, Agent, or Firm*—Birch, Stewart, Kolasch & Birch, LLP

[57] ABSTRACT

The present invention relates to sports post for athletics, which are light, tough, easily to set up or taken down. The sports post have two or more fiber reinforced plastic hollow tubes that are fitted and connected together. A screw-type extension and retraction mechanism is built within the posts. The sports posts have a rod shaped member fixed to one hollow tube that passes through the through-hole of an element fixed to another hollow tube. Another embodiment of the present invention includes sports posts in which the reinforcing fiber layer from which the hollow tubes are composed include, a laminate structure of sheet-shaped material. The sports posts include a laminate structure of a sheet shaped material in which the fiber is carbon fiber and filaments thereof are unidirectionally arranged, and of a filament bundle structure layer which can be seen from outside.

17 Claims, 3 Drawing Sheets

SPORTS POSTS

This application is the national phase under 35 U.S.C. §371 of prior PCT International Application No., PCT/JP96/02899 which has an International filing date of Oct. 04, 1996 which designated the United States of America, the entire contents of which are hereby incorporated by reference.

TECHNICAL FIELD

The present invention relates to sports posts such as net posts, goal posts and posts for athletics, which are light, tough, easily set up and taken down and, moreover, excellent aesthetically.

TECHNICAL BACKGROUND

Hitherto, the net posts used in volleyball and tennis, and the sports posts for soccer, rugby, American football and athletics, etc, have been made of iron or stainless steel metal. In the case of net posts in particular, in order to counter the bending moment generated when tension is applied to the net wire, the main structural parts have been made of fairly thick-walled metal from the point of view of strength. Further, the general extension/retraction mechanism in such posts is usually a system in which two or more hollow tubes are connected by fitting together telescopically, with the inner tube(s) being raised or lowered by means of a screw mechanism. With this extension/retraction mechanism, when an operating handle is introduced into an insertion hole provided in the outer tube side face and a built-in bolt rotated via a bevel gear, the inner tube to which a nut is fixed is raised and, in this way, adjustment is possible to the appropriate net height for each sporting event. When rotating the bolt, it is necessary to prevent co-rotation of the nut portion. In conventional steel posts, a lead-in groove is cut in the surface of the inner tube to which the nut is fixed, running in the axial direction of the tube. A key provided in the outer tube engages this lead-in groove. In this way, it is possible to raise and lower the inner tube without co-rotation occurring along with the rotation of the bolt.

Conventional thick-walled metal sports posts are extremely heavy, and considerable physical effort is required in their setting up and taking down. For example, taking the case of net posts, which are one type of sports posts, when these are employed in a multi-purpose location such as a gymnasium, unlike in a dedicated court, the posts have to be frequently set up and taken down, and where the net posts are long and, consequently, heavy, like the posts for volleyball, their setting up and taking down is accompanied by physical strain on the part of the user.

DISCLOSURE OF THE INVENTION

The sports posts relating to the present invention are sports posts characterized in that two or more fibre reinforced plastic hollow tubes are fitted and connected together and, moreover, a screw type extension and retraction mechanism is built-in and, preferably, they are sports posts where a rod shaped member fixed to one hollow tube passes through the through-hole of an element fixed to another hollow tube.

Further, another embodiment of the present invention includes sports posts where the reinforcing fibre layer from which the hollow tubes are composed has a laminate structure of a sheet-shaped material of the fibre, preferably predominantly sheet-shaped material in which the fibre is carbon fibre and filaments thereof are unidirectionally arranged. More preferably, these sports posts include a laminate structure of a filament bundle structure layer which can be seen from the outside. As the filament bundle structure, woven materials or a wound filament bundle, etc, are used.

The present invention is characterized in that the main structural parts of the sports posts are composed of a fibre reinforced plastic which is light and tough, and while still maintaining the strength to withstand a large bending moment, a considerable reduction in weight is achieved. With this invention, it is possible to markedly reduce the physical strain at the time of the setting up and taking down of sports posts where frequent such setting up and taking down is required, in particular with net posts for volleyball and tennis.

Further, in the case where two or more fibre reinforced plastic hollow tubes are fitted and connected together, and then extended or retracted, if a key lead-in groove for preventing co-rotation is provided by cutting the tube surface, like in the case of conventional steel posts, the reinforcing fibre of the fibre reinforced plastic is severed and there is a substantial reduction in strength. In the present invention, by employing a special co-rotation prevention mechanism in which a rod shaped member is fixed to one hollow tube and passes through the through-hole of an element fixed to another hollow tube, there is obtained an expansion/retraction mechanism in which there is no severing of the reinforcing fibre and no impairment of the inherent strength of the tube, and unnecessary cost increases are avoided.

The present invention will become more fully understood from the detailed description given hereinbelow and the accompanying drawings which are given by way of illustration only, and thus are not limitative of the present invention, and wherein:

EXPLANATION OF THE NUMERICAL CODES

Figure 1:
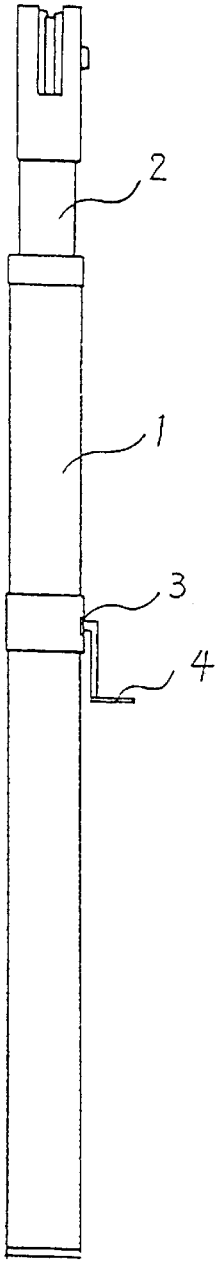
FIG. 1 is a side view of an extending/retracting net post for volleyball, which is one sports post of the present invention.

1: outer tube
2: inner tube
3: handle insertion hole
4: raising/lowering handle
5: bevel gear
6: raising/lowering screw bolt
7: raising/lowering screw nut
8: rod shaped member
9: raising/lowering screw bolt fixture
10: lead-in hole Optimum Configurations for Practising the Invention As the fibre reinforced plastic referred to in the present invention, there can be employed any kind of fibre reinforced plastic where resin and fibre are combined to achieve a reduction in weight and where the fibre provides the strength but, in terms of the objectives of the present invention, one that provides both lightness and high strength is required. As the reinforcing fibre for realising this objective, a high tenacity fibre of tensile strength desirably at least 20 g/d is desirable. Further, from the need to keep the post deflection to same level as iron or stainless steel, a high tenacity fibre with a high tensile modulus is used. As a high tenacity fibre which meets this objective, there is preferably used fibre of tensile elastic modulus at least 5,000 kgf/mm2 and, more preferably, at least 20,000 kgf/mm2. Further, in the case where two or more hollow tubes are fitted and connected together, it is especially preferred that on the outer tube side where bending stresses are concentrated there be used high tenacity fibre of still higher elastic modulus, for example carbon fibre the tensile elastic modulus of which is raised to the 30,000 kgf/mm2 level by a graphitization treatment (graphitized fibre), or the like.

Such fibre is produced according to the factors of material, spinning method and after-processing. In regard to the fibre material factor, there can be used aromatic polyamide fibres, carbon fibres, glass fibres and light metal fibres, etc. As fibre spinning method factors, there can be used fibre spun using a high molecular weight polymer as the starting material, after which drawing is carried out at a high draw ratio, and as fibre after-processing factors there can be used fibre drawn while exposing to radiation including a plasma discharge. As fibre based on the latter two methods there can be used polyester fibre, polyamide fibre, polyolefin fibre, polyvinyl alcohol fibre and polyacrylonitrile fibre, etc. Of these fibres, for the purposes of the present invention, from the point of view of the thermal properties when moulding as a composite material there is preferably used a fibre which, along with being of high tenacity and high modulus, also has excellent heat resistance. In this sense, carbon fibre (including graphitized fibre) is especially preferred.

The chief objective of such fibre is the reinforcement of the post and, consequently, it is preferably combined with the resin in a form and structure such that the properties of the said fibre are fully manifested. In regard to said fibre form or structure, it is preferred that the post be produced using a sheet-shaped material comprising said fibre, that is to say at least one type comprising paralleled fibre sheet, woven material or nonwoven material, wound to produce a hollow shape. Specifically, there is desirably employed a sheet-wound structure produced by, for example, firstly forming a filament bundle of said fibre into a paralleled fibre sheet-shaped material or into a woven material, and then winding this. Further, it is also possible to form a hollow wound structure by winding a plurality of layers of the filament bundle directly onto a core without said filament bundle being made in sheet form, which is referred to as a filament-wound structure, and such structures are also desirably employed. Of course, the fibre reinforced layer may also be constructed by using the two types of structure together.

In regard to such sheet-shaped materials or filament bundles, in order to increase the strength of the posts utilising the tenacity of high tenacity fibre, for at least one of the components in said posts there is preferably employed a structure having a parallel unidirectional arrangement in the circumferential direction of said post, specifically the structure applied to a fishing rod. Again, said sheet-shaped material or filament bundle is desirably given a discharge treatment or a matrix resin affinity treatment with the objective of improving the adhesion to the resin.

Furthermore, where the reinforcing fibre layer of the outermost layer is a filament bundle structure layer which can be seen from the outside and a transparent resin is used as the matrix resin, it is possible to use the pattern of the filament bundle structure layer as a decoration as it is, so its design characteristics are excellent. Here, a filament bundle structure is a woven material or filament bundle wound structure and, furthermore, in order that such a structure be visible from the outside, the width of the filament bundle viewed planarly is at least 1 mm and, more preferably, at least 2 mm. Moreover, as specific woven material structures, plain weave, twill weave and satin weave are the basic structures, and these and derivative weaves based thereon may be appropriately used according to the decoration required. For example, in the case of a twill weave the structure is somewhat larger so the pattern is larger, while with a satin weave, since it is possible to reduce weave crossover points compared to plain and twill weaves, it is possible to produce a pattern which is extremely smooth and lustrous.

From the point of view of realising a reduction in weight, the matrix employed in the fibre reinforced composite material is preferably one of low specific gravity and, for this reason, the use of a resin is preferred. As said resin, there may be used a natural resin, but the use of a high molecular weight synthetic resin is desirable. Of such synthetic resins, the use of a thermosetting resin with outstanding thermal and mechanical properties is preferred. Amongst thermosetting resins, phenolic resins, epoxy resins or unsaturated polyester resins are desirably employed in terms of toughness and processing characteristics.

As described above, if the hollow tubes from which the sports posts are constructed are moulded by means of a fibre reinforced composite material, there is a considerable improvement in particular in terms of lightness when compared to conventional metal-made posts. Furthermore, in terms of bending strength and bending rigidity, the performance conferred is the same as metal-made posts. However, in regard to the mode of failure when an excessive load is applied to the post, there is a strong possibility of differences arising between a metal and a fibre reinforced material. That is to say, the relation between the load and deflection exhibits essentially elastic characteristics up to failure in the case of a fibre reinforced composite material, whereas in the case of a metal, while elastic characteristics are shown up to a certain load, once the yield point has been exceeded the rigidity then falls greatly and plastic deformation characteristics are shown. In other words, even though the load countering capacity of both is at the same level, in the metal case a ductile failure mode is displayed whereas with the fibre reinforced material a brittle failure mode is shown. Consequently, at the practical level, in the case where an unexpectedly great load is applied to the post, with a metal tube sufficient warning is obtained up to failure occurring, so, in this respect, metal is superior to a fibre reinforced material.

Hence, from the point of view of compensating for the disadvantages of both, the production of the hollow tubes from which the sports posts are composed in the form of a hybrid structure of fibre reinforced plastic and metal is more preferred than constructing the post from a fibre reinforced plastic alone. Here, in the hybrid structure, it will suffice that the fibre reinforced material and the metal are closely affixed in layered fashion, and the lamination pattern is not especially restricted. However, from a processing standpoint, a structure in which the metal layer is closely affixed at the hollow tube inner layer side is preferred. That is to say, generally speaking, in the formation of a hollow tube by means of a fibre reinforced composite material, there is conducted the winding of a sheet-shaped material or filament bundle of said fibre as explained above and, in such circumstances, the winding is performed using a metal rod known as a mandrel as the core. If a hollow tube made of metal is used instead of this mandrel then, as well as it being possible to dispense with the normally required stage of withdrawing the mandrel, it is also possible to obtain the desired hybrid structure. The material for this metal-made hollow tube is not particularly restricted but, for the purposes of reducing the weight, the selection of a metal of low specific gravity such as aluminium is preferred. Again, the wall thickness needs to be decided based on a balance between the weight reducing effect and the brittle failure prevention effect, and this will vary according to the diameter of the hollow tube and the type of metal used. However, a lower limit of wall thickness is required sufficient to withstand the pressure of the triple-roll or the rolling table, etc, in the reinforcing fibre sheet-shaped material winding stage.

Next, in the present invention, two or more fibre reinforced plastic hollow tubes are fitted and connected together, and when providing the extension/retraction function a novel screw-type extension/retraction mechanism is employed. In short, in the provision of a built-in extension/retraction mechanism with a co-rotation preventing function, not only from the point of view that a cutting process such as providing a lead-in groove by cutting the inner tube as in the case of conventional steel posts leads to a substantial reduction in the strength, but also from the point of view of the resulting inevitable cost increase, this kind of means has not been employed, and instead there has been employed a special co-rotation prevention mechanism utilising a rod shaped member.

The extension/retraction mechanism of the present invention is now explained based on the drawings. The extension/retraction mechanism of the present invention is a system whereby, to a nut portion provided on one inner tube, there is fitted the bolt of a bolt rotation mechanism provided on the inside of another outer tube, and by rotating the bolt of this bolt rotation mechanism via a bevel gear, the said inner tube is raised or lowered, but the characteristic feature lies in the fact that co-rotation is prevented by passing a rod shaped member fixed to the said one hollow tube through a through-hole fixed in the other hollow tube.

Figure 2:
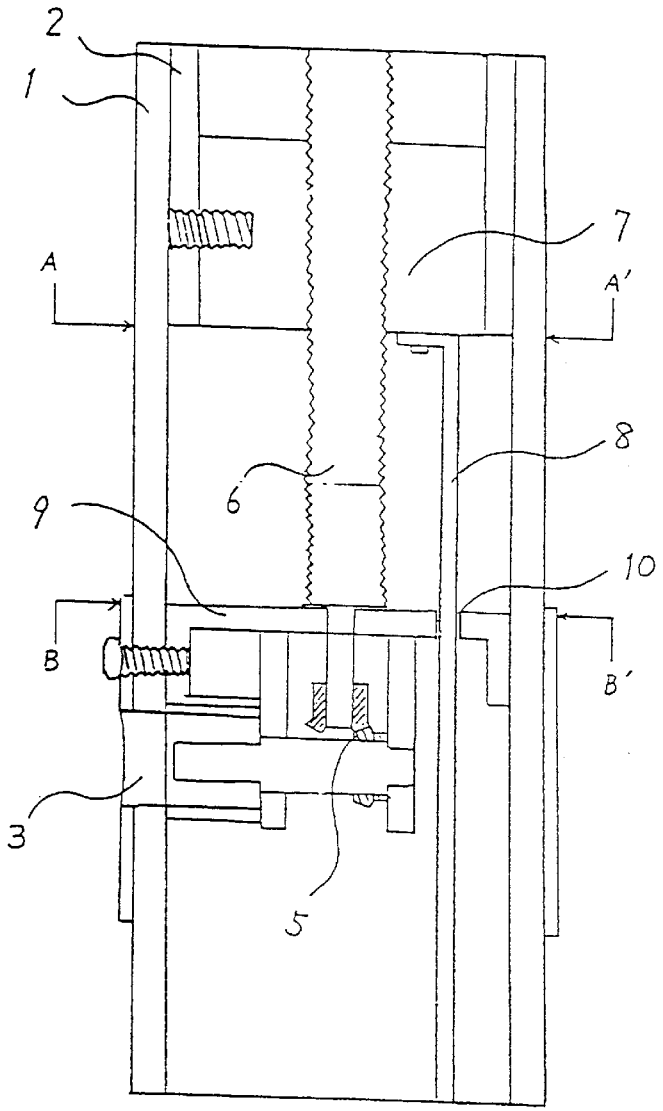
FIG. 2 is a sectional view of the raising/lowering mechanism within the sports post of the present invention.

FIG. 1 is a view of the entire structure of a net post for volleyball to which the present invention has been applied, and FIG. 2 is a cross-sectional view showing the raising/lowering mechanism in the interior. Below, the extension and retraction mechanism of the net post in this present patent application is explained using these drawings. Reference numeral 1 is an outer tube and reference numeral 2 is an inner tube, and these are fitted and connected together in the manner of a telescope or aerial. The post height is adjusted by raising or lowering the inner tube. In the case where the net post is to be extended or retracted, a bolt rotation mechanism is used in which, firstly, the handle 4 used for raising/lowering is inserted into the handle insertion hole 3 provided in the outer tube side face and the rotation thereof is transmitted to a bevel gear 5. By means of this bevel gear, as well as the axis of rotation being made to change direction so that it matches the tube axis, the rotation is transmitted to raising/lowering screw bolt 6 which is internally fixed in the outer tube. In the inner tube, there is fixed raising/lowering screw nut 7 which corresponds to the raising/lowering screw bolt 6, and inner tube 2 is raised or lowered according to the rotation of the screw bolt 6. Thus far, the mechanism is the same as a conventional built-in screw type extension and retraction mechanism.

A characteristic feature of the present invention lies in the mechanism for preventing the co-rotation of the raising/lowering screw nut 7. That is to say, internal screw-based extension/retraction is only possible by suppressing rotation of the screw nut, but naturally this suppression of rotation must not inhibit the raising/lowering movement of the inner tube. Accordingly, in a conventional steel-made net post, a lead-in groove is cut into the surface of the inner tube 2, running in the tube axial direction, and a key which has been provided in the outer tube 1 fits into this lead-in groove, so that by the movement of this key within the lead-in groove co-rotation is prevented without obstructing the extension/retraction.

Figure 3:
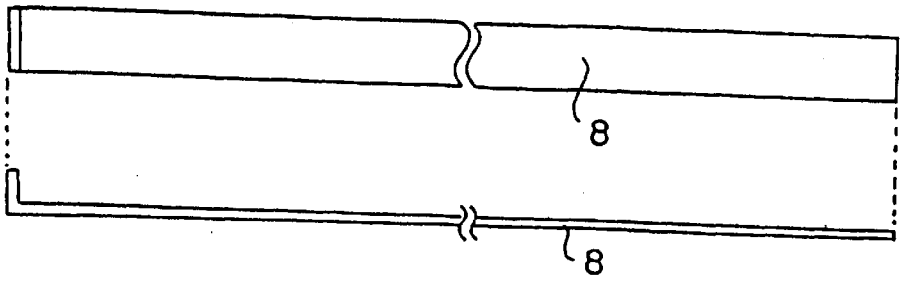
FIG. 3 is a side view showing an L-shaped bar which is one example of the rod-shaped member used for preventing co-rotation.
Figure 4:
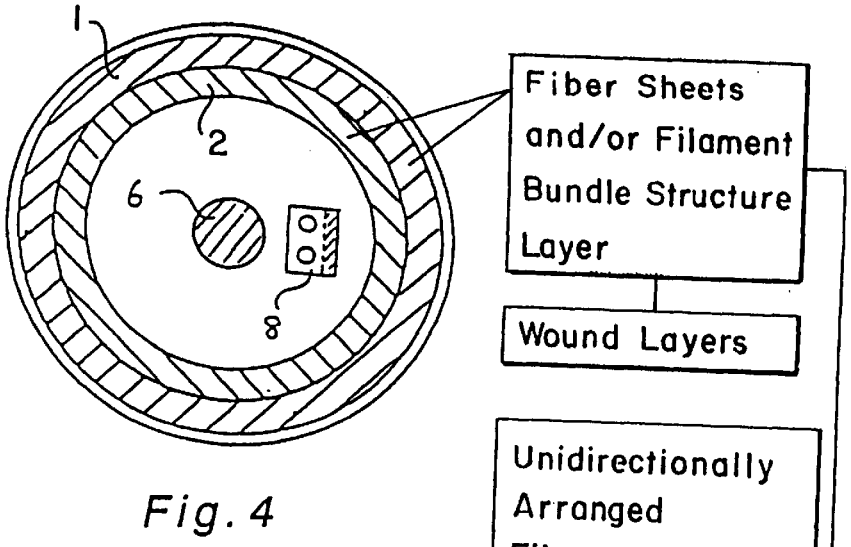
FIG. 4 is the cross-section through A—A in FIG. 2.
Figure 5:
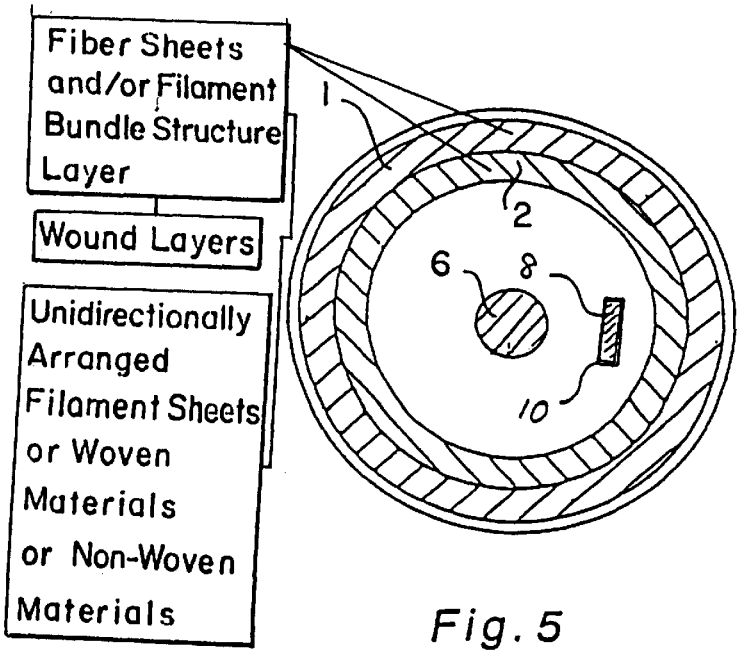
FIG. 5 is the cross-section through B—B in FIG. 2.

In the present invention, the co-rotation of the raising/lowering screw nut is prevented by a completely different method from this conventional mechanism. That is to say, there is employed a mechanism whereby a rod shaped member fixed to one hollow tube passes through the through hole of an element fixed to another hollow tube. Explaining a specific example by means of FIG. 2, rod shaped member 8 is fixed to raising/lowering nut 7 such that it is parallel to but does not touch raising/lowering screw bolt 6 and, furthermore, this rod shaped member 8 passes through lead-in hole 10 provided in raising/lowering screw bolt fixture 9 which is fixed within the outer tube 1. Here, FIG. 3 shows an example of the rod shaped member (an L-shaped bar) used in the present invention. Furthermore, FIG. 4 is a sectional view through A—A in FIG. 2, and it shows the L-shaped bar in FIG. 3 bolted to raising/lowering screw nut 7. FIG. 5 is a sectional view through B—B in FIG. 2 and shows the L-shaped bar suspended from raising/lowering screw nut 7 passing through the lead-in hole 10 provided in raising/ lowering screw bolt fixture 9.

By making the length of the rod shaped member at least longer than the actual extension/retraction length, this rod shaped member 8 passes freely up and down through lead-in hole 10, merely preventing co-rotation of the screw nut. The rod shaped member may be of any shape such as a circular or angular column, but it is necessary that it be straight and without differences in level, grooves or projections, etc, which would inhibit movement in its lengthwise direction. The material of the rod shaped member is not particularly restricted providing it has a strength and stiffness such that breakdown or large distortions do not occur when preventing the co-rotation.

The improvement effect in terms of the strength properties of a net post based on the structure according to the present invention will differ considerably depending on the tube material. Thus, when the tube material used is a fibre reinforced plastic for the purposes of weight reduction, then the improvement effect in this respect is very considerable compared to a steel product. In the case where a lead-in groove is provided in the same way as a steel post, cutting is carried out at a width of about 5 mm and to a depth of about 3 mm from the tube surface, but since the bending strength and rigidity of the tube are manifested based on the tensile strength and tensile rigidity of the reinforcing fibre in the fibre reinforced plastic, following the cutting the reinforcing fibres in the fibre reinforced composite material layer are severed in proportion to the depth of the groove and the strength properties are not at all as desired. Since, the wall thickness of the inner hollow tube can be reduced the higher the tenacity of the reinforcing fibre, cutting a groove in the conventional manner leads to a fatal reduction in the strength. Thus, where a net post is moulded by means of a fibre reinforced composite material, the construction employed in the present invention in which no cutting is required is essential.

The sports posts of the present invention can also be used for example as posts for supporting nets such as those for golf practice ranges and baseball grounds, etc, where it is important that they be strong and light, and where they also have the considerable feature that setting up and taking down is easy. The sports posts referred to in the present invention include net posts for volleyball, tennis, badminton, golf, baseball and table tennis, goal posts for soccer, rugby, American football, handball and hockey, and also the various kinds of posts and frameworks such as hurdles used in athletics, etc. If the sports posts of the present invention are employed as the various kinds of posts for ball games in multi-purpose locations like gymnasia where the setting up and taking down of said posts is frequently carried out, then the effects in terms of reducing the physical effort at the time of such setting up and taking down of the posts are markedly apparent. As stated above, the net posts for sports in the present invention can be employed widely for games and sports conducted both indoors and outdoors, and include rod shapes and frameworks. Further, providing the tubes are hollow, the cross-sectional shape of such tubes does not have to be circular and can be changed to be elliptical, angular, etc, according to the usage objectives, and it is possible to construct various types of apparatus employed in said games and sports.

EXAMPLES

Example 1

The extending/retracting net post shown in FIG. 1 was constructed as a net post for volleyball. Firstly, the hollow tubes forming the main structural members of the net post comprised fibre reinforced plastic in which carbon fibre filament was the reinforcing fibre. As the carbon fibre filament, there was selected a high modulus type of strength 40 g/d and tensile modulus 30,000 kgf/mm$^2$, and sheet prepreg in which epoxy resin was the matrix was moulded in the form of tubes of wall thickness 6.0 mm by a sheet winding method. As the actual sheet winding method, the rolling table method was selected and, as the laminate pattern, unidirectional prepreg was oriented at 0° and ±45° to the circumferential direction and a strengthwise balance obtained.

Figure 6:
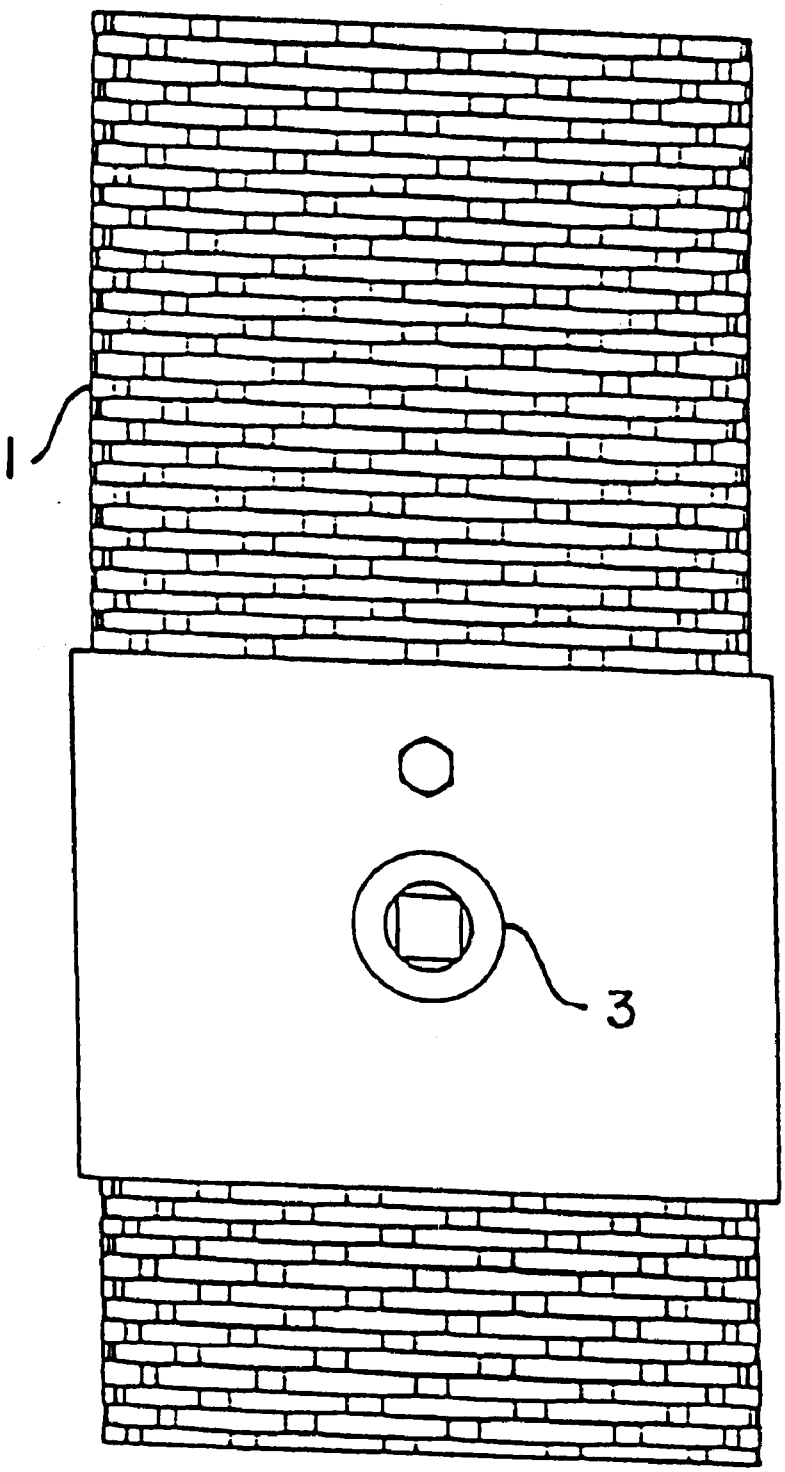
FIG. 6 is a partially enlarged view showing one example of the surface of a sports post of the present invention, and illustrates the decorated state when the outermost layer portion is composed of a woven fabric-form filament bundle structure layer.

In relation to this net post, the number of plies in each direction was determined such that the 0° and ±45° balance ratio was set at 4:1. Further, for decoration in the outermost layer, a 5-end satin weave sheet was employed. These sheet prepregs were firstly laid-up by wrapping around a mandrel while applying a pressure of 3 kg/cm$^2$ with a rolling table and then wrapping tape wound around, after which curing was carried out at 130° C. in a curing oven and, finally, the mandrel withdrawn. Two hollow tubes of different tube diameter obtained by this moulding method were fitted together in telescopic fashion, then the parts other than the main structural members fitted, namely the pulley portion, wire take-up portion and the screw bolt and nut for raising and lowering, etc, and the volleyball net post thus assembled. Now, in the net post of this example a steel L-shaped bar as shown in FIG. 3 was also fixed to the raising/lowering screw nut 7 shown in FIG. 2, and this bar was made to pass through lead-in hole 10 provided in the raising/lowering screw bolt fixture 9. Again, the length of the L-shaped bar was set to be sufficient such that even when the net post was extended to its maximum it did not come out of the lead-in hole. Now, because the fibre layer was visible through the transparent epoxy resin, the net post surface obtained was decorated as shown in FIG. 6 by means of the woven texture of the outermost layer.

Comparative Example 1

In this comparative example, a net post was constructed having a screw type raising and lowering mechanism of the same kind as in conventional steel posts. Thus, firstly, hollow tubes of wall thickness 6.0 mm in which the reinforcing fibre was carbon fibre filament were an identical method to that in Example 1, but the outer face of the inner tube was cut to form a groove of depth 3.0 mm and width 5.0 mm continuously in the lengthwise direction. A key to fit this groove was provided at the inner wall portion of the outer tube tip, and then the net post assembled with this key fitted into the groove in the outer wall of the inner tube.

Comparative Example 2

This was a conventional steel-made commercial net post for volleyball and, in the same way as in Comparative Example 1, a groove was cut in the outer face of the inner tube and a key provided on the inner wall at the tip of the outer tube. The wall thickness of the tubes was 5.2 mm.

Example 2

Hollow tubes were moulded by the sheet winding method using carbon fibre filament as the reinforcing fibre in the same way as in Example 1, but instead of the mandrel an aluminium tube of wall thickness 1.0 mm was used as the core, and a laminate structure of aluminium and a carbon fibre reinforced resin layer obtained. The adhered state of the aluminium and the fibre reinforced resin layer was sufficient for practical purposes, and there was no particular need to use a primer or the like. Further, the total wall thickness of the hollow tube obtained was made 6.0 mm, the same as in Example 1, and the internal raising and lowering mechanism was also the same.

Table 1 shows the results of an evaluation of the operation of the raising and lowering device in these net posts and of the bending characteristics of the hollow tubes. The operation of the raising and lowering device was judged based on the resistance when turning the raising and lowering handle by hand without introducing wire tension. In regard to the bending characteristics, reference was made to the Recognised Standards Confirmation Method relating to safety and quality of volleyball equipment as stipulated by the Product Safety Committee. Firstly, in a state such that the post height was held at 2430 mm, an initial tension of 50 kgf was introduced and the net extended and stabilised for at least one minute. Next, taking this state as the standard, a further 200 kgf load was applied and after stabilizing by holding for at least one minute, the level of post deflection was measured by means of a scale. According to the Recognised Standard of the Product Safety Committee, when a load of 250 kgf is applied to a steel-made post, the deflection must be no more than 130 mm.

As explained above, the volleyball net posts based on the present invention were made of carbon fibre reinforced plastic and so, when contrasted with Comparative Example 2 which was a conventional steel-made net post, the weight was less than ⅓, and not just the carrying of the posts at the time of setting up and taking down but also the operation of the raising and lowering device was light and easy. Again, in the case of Comparative Example 1, which was made of the same carbon fibre reinforced plastic and only the raising/lowering mechanism was the same as in a conventional steel post, while there was no difference in the ease of operation, the level of deflection of the post when the tension was applied was greater than that in Example 1 and Comparative Example 2 when tension was applied. In order to avoid any danger, measurement was halted at the point when the deflection exceeded 200 mm. Thus, as well as exhibiting a deflection which would leave the players feeling uneasy, the strength of the post in Comparative Example 1 where the inner tube had been subject to cutting was also clearly reduced, and it was confirmed that the post was impossible to use without markedly increasing the wall thickness. In Example 2, while the weight and deflection were slightly increased, the operational characteristics of the raising/lowering device were no different when compared to Example 1 and, in practical terms, the difference in weight and deflection were such as to be hardly noticed. From the above results it is clear that, in the case where a fibre reinforced plastic is used as the main structural material of the net posts, by means of the construction in this present application in which no cutting is carried out it is possible for the first time to realise satisfactory lightness, raising/lowering operational properties and bending characteristics (level of deflection).

TABLE 1

| | Example 1 | Comparative Example 1 | Comparative Example 2 | Example 2 |
|---|---|---|---|---|
| Tube diameter (external diameter of outer tube) | 76.3 mm | 76.3 mm | 76.3 mm | 76.3 mm |
| Tube wall thickness | 6.0 cm | 6.0 cm | 5.2 cm | 6.0 cm |
| Weight (per set) | 20.8 kg | 20.7 kg | 71.4 kg | 22.4 kg |
| Raising/lowering operational characteristics | ◎ | ◎ | ○ | ◎ |
| Level of defection (tension 250 kgf) | 118.4 mm | above 200 mm | 115.8 mm | 128.2 mm |

Note:
The weight includes the pulley portion, wire take-up portion and the screw bolt/nut for raising lowering, etc.

We claim:

1. A post system for a sports net comprising:

a first hollow tube;

a second hollow tube, said first hollow tube being disposed within said second hollow tube;

a screw nut fixing element being disposed within said first hollow tube;

a screw fixing element being disposed within said second hollow tube;

a screw being rotatably supported by said screw fixing element and being operatively connected to said screw nut fixing element;

a screw drive mechanism disposed within said second hollow tube and operatively connected to said screw; and a rod preventing rotation of said screw nut fixing element, said rod being slidably engaged with one of said screw fixing element and said screw nut fixing element and being fixed to one of said screw fixing element and said screw nut fixing element, said first hollow tube and said second hollow tube including a fiber reinforced plastic.

2. The post system for a sports net of claim 1, wherein said reinforced plastic comprises carbon fibers.

3. The post system for a sports net of claims 1 or 2, wherein said fiber reinforced plastic comprises a laminate of reinforcing fiber sheets.

4. The post system for a sports net of claim 3, wherein said fiber reinforced plastic sheets comprise at least one of unidirectionally arranged filament sheets, woven materials, and non-woven materials.

5. The post system for a sports net of claim 3, wherein said fiber reinforced plastic comprises unidirectionally arranged filament sheets and a filament bundle structure layer disposed on an external surface of said reinforced plastic material.

6. The post system for a sports net of claim 5, wherein said filament bundle structure layer comprises woven material.

7. The post system for a sports net of claim 5, wherein said filament bundle structure layer comprises a wound layer.

8. The post system for a sports net of claim 5, wherein said filament bundle structure has a width of at least 1 mm.

9. The post system for a sports net of claim 8, wherein said filament structure has a width of at least 2 mm.

10. The post system for a sports net of claim 1, wherein said fiber reinforced plastic comprises filament bundle wound layers.

11. The post system for a sports net of claims 1 or 2, wherein reinforcing fibers of said fiber reinforced plastic have a strength of at least 20 g/d.

12. The post system for a sports net of claims 1 or 2, wherein reinforcing fibers of said fiber reinforced plastic have a tensile modulus of at least 5,000 kgf/mm$^2$.

13. The post system for a sports net of claims 1 or 2, wherein reinforcing fibers of said fiber reinforced plastic have a tensile modulus of at least 20,000 kgf/mm$^2$.

14. The post system for a sports net of claims 1 or 2, wherein said fiber reinforced plastic includes at least one of polyester fiber, polyamide fiber, polyolefin fiber, polyvinyl alcohol fiber, polyacrylonitrile fiber, light metal fiber, and glass fiber.

15. The post system for a sports net of claims 1 or 2, wherein said first hollow tube has reinforced fibers of a first modulus, said second hollow tube has reinforced fibers of a second modulus, said second modulus is higher than said first modulus.

16. The post system for a sports net of claims 1 or 2, wherein said fiber reinforced plastic includes a metal layer, said metal layer being an innermost layer of said fiber reinforced plastic.

17. The post system for a sports net of claims 1, 3 or 10, wherein said fiber reinforced plastic includes a matrix resin, said matrix resin is disposed on an external surface and is a transparent thermosetting resin.

* * * * *